US006149529A

United States Patent [19]

Fowler et al.

[11] Patent Number: 6,149,529

[45] Date of Patent: Nov. 21, 2000

[54] COMBINATION FOOTBALL AND SKATING GAME WITH ENCLOSED RAMP FIELD AND DIFFERENT SCORING ZONES

[75] Inventors: William L. Fowler, Granada Hills; Ronald A. Holland, Newport Beach; Bruce E. Austin, Burbank; Joseph M. Skorpen, Malibu, all of Calif.

[73] Assignee: Hemisphere Group, Inc., Irvine, Calif.

[21] Appl. No.: 09/302,585

[22] Filed: Apr. 30, 1999

[51] Int. Cl.[7] ..... A63C 19/10

[52] U.S. Cl. ..... 472/89; 472/92; 473/470; 473/415

[58] Field of Search ..... 472/136, FOR 88–92; 473/415, 465, 470–474, FOR 120–127; 273/FOR 124; D21/355–359

[56] References Cited

U.S. PATENT DOCUMENTS

| | | | |
|---|---|---|---|
| 3,201,126 | 8/1965 | Nissen . | |
| 3,388,909 | 6/1968 | Woods . | |
| 3,580,573 | 5/1971 | Noonan | 473/470 |
| 3,880,441 | 4/1975 | Silver . | |
| 4,172,593 | 10/1979 | Palakanis | 473/471 |
| 4,258,911 | 3/1981 | Alexander | 473/471 |
| 4,482,157 | 11/1984 | McNeil . | |
| 4,715,598 | 12/1987 | Knight . | |
| 4,911,443 | 3/1990 | Foster | 473/470 |
| 5,207,433 | 5/1993 | Moore . | |
| 5,312,109 | 5/1994 | Cagle . | |
| 5,348,298 | 9/1994 | Montgomery . | |
| 5,390,913 | 2/1995 | Kepler . | |
| 5,588,647 | 12/1996 | Rudell et al. . | |
| 5,643,094 | 7/1997 | Macri et al. . | |
| 5,720,678 | 2/1998 | Korthauer . | |
| 5,906,545 | 7/1998 | Eden et al. | 472/92 |

OTHER PUBLICATIONS

Article from the Washington Post, by: Christine Brennan, "Arena Football", D–1, Apr. 1987.

*Primary Examiner*—Sebastiano Passaniti
*Assistant Examiner*—Mitra Aryanpour
*Attorney, Agent, or Firm*—Cislo & Thomas LLP; David L. Hoffman, Esq.

[57] ABSTRACT

A modified football game requires that players wear in-line skates and the field has a flat surface area having a substantially rectangular shape with two straight long sides and two second convexly curved short sides, a partial circular concavely curved second surface area bounding the first area and having a lower edge and an upper edge, the lower edge being contiguous with the edge of the first flat surface area, and the upper edge being remote from the flat surface area, and an upper flat lip surface area extending around the curved second surface area contiguous with its upper edge, and lines defining end zones proximate each of the second curved short sides of the flat surface area, each end zone having a flat surface area portion and a curved surface area portion of the curved second surface. The players skate on the flat area, the curved area and the lip. The players score a first amount of points for skating the ball into the end zone or catching the ball in the end zone in the flat surface area, and a second amount of points for catching the ball in the end zone on the curved area. There may also be a third highest amount of points for catching the ball in the end zone on an upper portion of the curved area. There are no goal posts, and thus there are no field goals or kicked point after attempts. The sides of the field corresponding to sidelines where the curved second surface area such as a quarter pipe or portion of a quarter pipe used in in-line skating is located is preferably a cut-off portion of quarter pipe, while the curved area in the end zone is preferably a full quarter pipe or a full quarter pipe with an extension upward, such that the height of the lip in the end zone is higher than that on the sidelines.

26 Claims, 4 Drawing Sheets

COMBINATION FOOTBALL AND SKATING GAME WITH ENCLOSED RAMP FIELD AND DIFFERENT SCORING ZONES

BACKGROUND OF THE INVENTION

The present invention relates to a combination football and in-line skating game using an enclosed substantially quarter pipe barrier, and more particularly, such a game where the barrier has a lip and changes height from the sideline to the end zone, and where the barrier and lip are part of the playing field.

In recent years in-line skating has gained substantially in popularity. In-line skating is fast and exciting. Skaters can reach high speeds. One natural extension of this sport has been to play street hockey on in-line skates, particularly because ice hockey is played on ice skates.

By contrast, a sport which has been popular for a long time is football. In fact, perennially the highest or one of the highest rated television shows is the Super Bowl, the championship game of the National Football League. People enjoy football for various reasons including the contact, the excitement of a kickoff return, the fundamental test of strength and power between the offensive and defensive lines, the agility of a running back evading tacklers, long pass plays, and the tactics of football offense and defense.

The traditional game of football has undergone very little change in this regard. One variation of traditional football is known as "arena football." Large nets or backboards are placed on opposite sides of the goalposts and the football is in play when it hits these backboards. However, the field on which the players play and the speed at which the game is played is relatively unaffected. A description of arena football is contained in U.S. Pat. No. 4,911,443 issued Mar. 27, 1990 to Foster.

Others have attempted to combine football with other sports but the basic excitement of football may be lost. For example, U.S. Pat. No. 4,482,157 issued Nov. 13, 1984 to McNeil shows how several sports including basketball, football, volleyball and soccer may be combined. This combined sport is a drastic change to football and the broad-ranging appeal of football is lost.

U.S. Pat. No. 5,207,433 issued May 4, 1993 to Moore discloses a game which modifies football to emphasize passing.

What is needed is a game which maintains the contact and excitement of traditional football yet enhances its speed and uses a uniquely structured barrier for the field which is part of the playing surface.

SUMMARY OF THE INVENTION

In one embodiment, the present invention provides a method of playing football and a structure for that method. It combines the speed of in-line skating with traditional football by putting players on in-line skates. More importantly, in a preferred embodiment the invention provides a uniquely structured barrier for the field, which barrier forms part of the playing surface.

The field structure includes a quarter pipe or a cut-off quarter pipe at approximately sixty to eighty degrees which extends around the playing field. In the end zones, the quarter pipe extends higher than on the sidelines so that there is a transition area from the sideline quarter pipe to the end zone quarter pipe. The transition area occurs in the height of the end zone and may also be in the width. In a preferred embodiment, there is a lip which extends around and outside of the top of the quarter pipe which is also part of the playing surface. Due to the wider areas of the end zone, in the preferred embodiment the field has a somewhat dog bone shape in plan view.

In a most preferred embodiment, the length of the field, not including the lip, is one hundred twenty yards, each end zone being fifteen yards deep, and the width of the field not including the lip is fifty-five yards. Preferably, the quarter pipe has a radius of curvature of fifteen feet, the sideline quarter pipe being cut off at twelve feet high and the end zone quarter pipe extending to seventeen feet high, two feet straight up at the top. There are no goalposts.

The end zone preferably has different scoring zones. The flat area of the end zone may be a first scoring zone, and the curved area may be a second scoring zone, or the curved area may be further divided into two additional scoring zones. Catching a ball in the end zone on the curved pipe would result in a higher score. Because there are no goalposts, there would be no field goals or traditional point after attempts. In general, the rules will be very similar to regular football and may include the following:

- 11–15 players on a side;
- players must wear in-line skates (preferably with relatively large wheels for blocking and other strength positions and smaller wheels for running and receiving positions);
- players may play on the quarter pipe and on the lip, but a ball hitting the quarter pipe would be dead if thrown;
- players may only perch on the lip for a limited time; and
- for kickoff the ball must be kicked at least sixty-five (65) yards and the players may begin by swarming down from the lip at each end zone, although this is not required.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention.

While the present invention has been described with regards to particular embodiments, it is recognized that additional variations of the present invention may be devised without departing from the inventive concept.

The game may be played on a modified in-line skate designed to obtain a push start for quick acceleration and blocking, e.g., while leaning forward. Such a skate is disclosed in a concurrently filed U.S. patent application entitled SAFETY BRAKE FOR IN-LINE SKATES, filed on the same day as the present application, and invented by Ronald A. Holland, which is hereby incorporated by reference. The serial number of the application is not yet known.

In a preferred embodiment, the invention combines football and in-line skating to form a game that is comparable to football played on in-line skates, but with a substantially modified field and modified rules. Protective gear the same as or similar to that used in football or other contact sports may be used. Preferably, a uniform or gear would include a hard exterior shell covering the head and back of the player; and an artificial spine on which to mount the shell, which spine may articulate comparable to a human spine. The spine should be mounted to some of the protective gear to distribute force to the player's body. A harness like a skydiving or rappelling harness may be worn to hold hip pads and also support the artificial spine.

Figure 1:
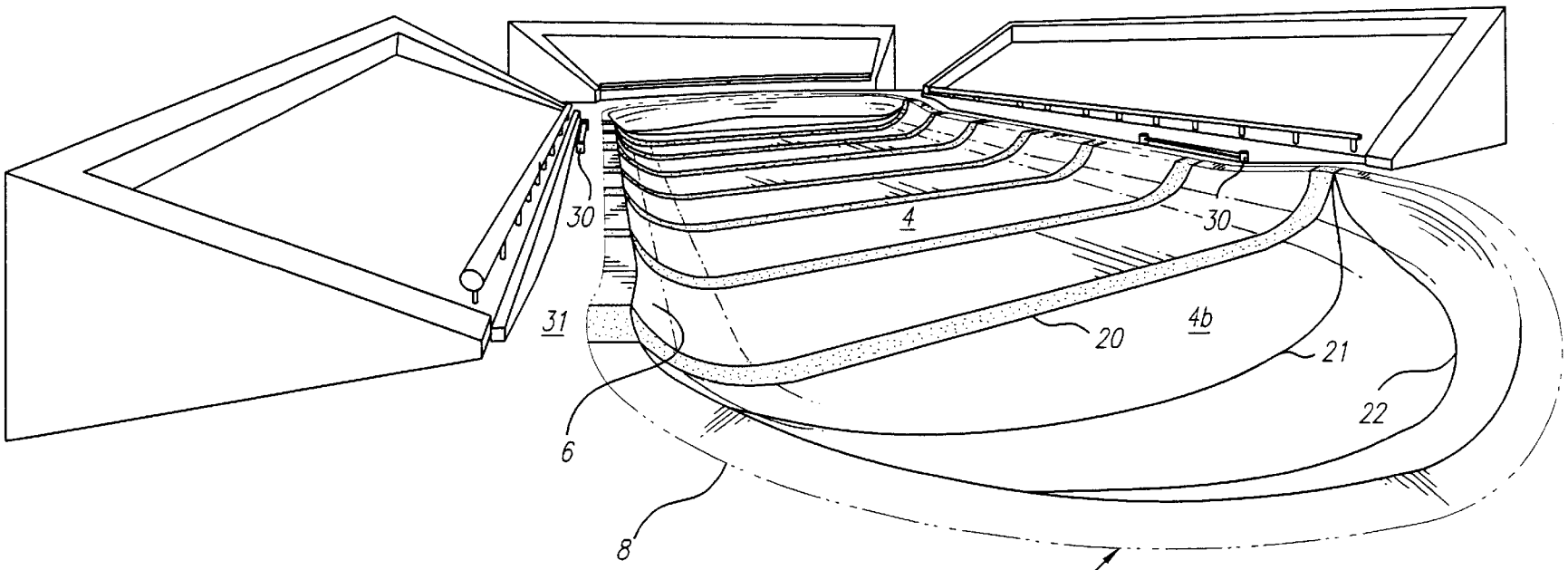
FIG. 1 is a perspective view of the structure of the playing field according to the invention.
Figure 2:
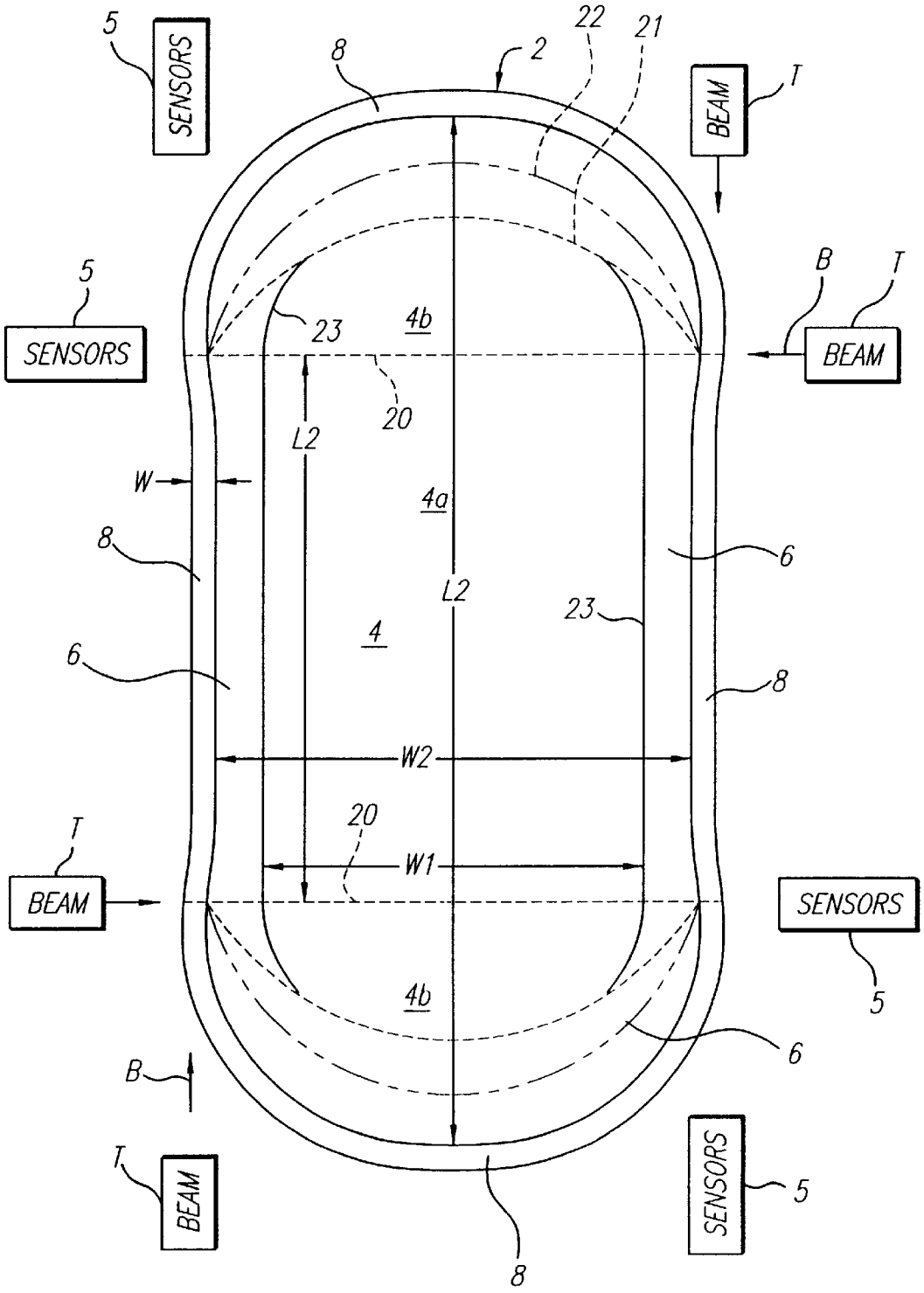
FIG. 2 is a top partial schematic view of the playing field of FIG. 1.
Figure 3:
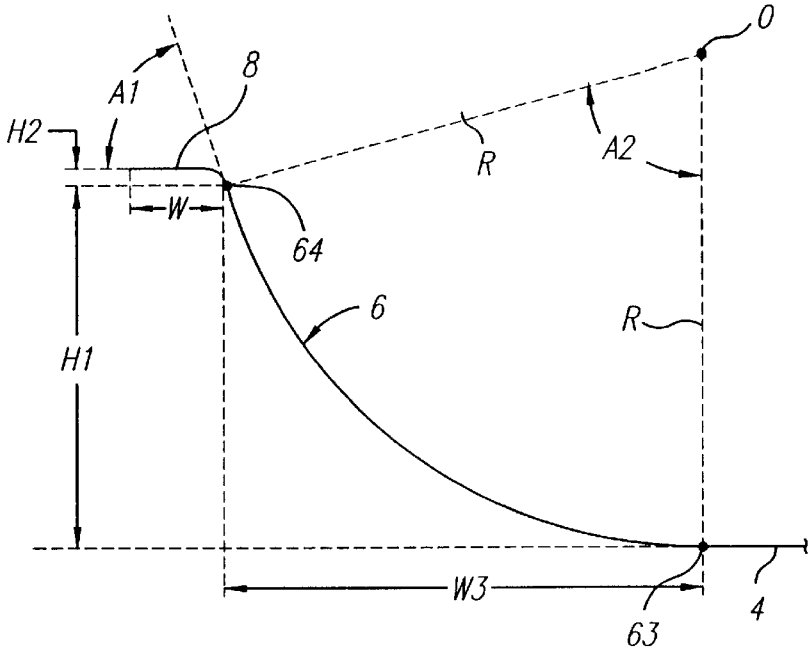
FIG. 3 is a schematic cross-sectional view of the lip and quarter pipe at a sideline of the field according to the invention.
Figure 4:
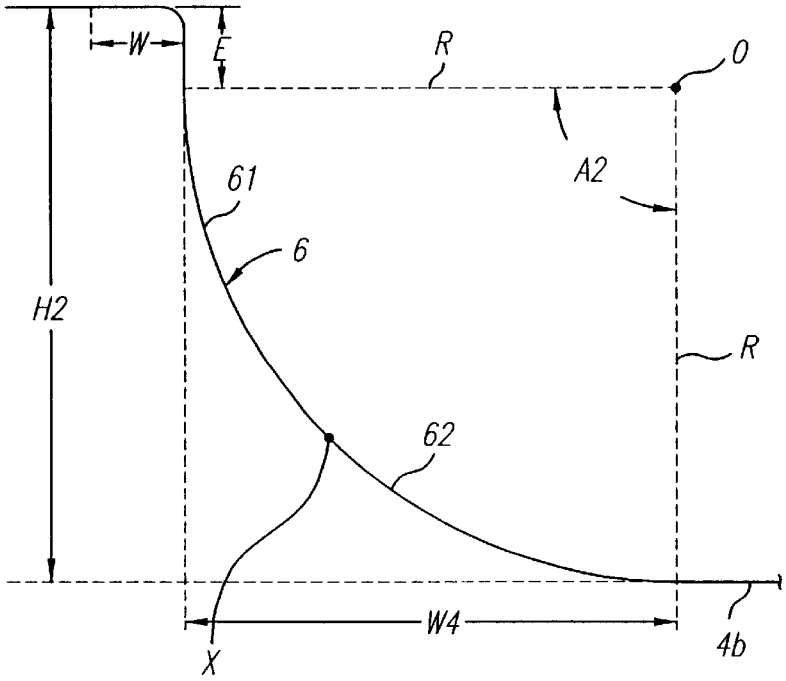
FIG. 4 is a view similar to that of FIG. 3 but taken at the end zone.

With reference to FIGS. 1–4, field 2 has a flat first area 4 bounded by a second curved area 6 which is further bounded by a flat lip area 8. The curved second area 6 is formed by a substantial quarter pipe, as is often used in in-line skating parks and is well known in the art. FIGS. 3 and 4 show a schematic view of the curve of the quarter pipe 6. The pipe has a radius R, which is preferably constant all the way around the field although it could be made to vary. The quarter pipe along sidelines corresponding to a length L1 of the playing field between end zones, meets the flat first area 4 at a point 63 where the pipe then curves upward to a point 64, which may be less than a quarter pipe. The height H2 of this point 64 above the flat first area 4 as is shown in FIG. 3, the radius of curvature R from a point O is preferably constant along the curved second area 6. At the top portion of the curved second area 6, there is lip 8 which extends for a width W.

The angle A1 of the substantial quarter pipe may be selected at, for example, 60 degrees or 78.5 degrees, or any other appropriate angle. The section of quarter pipe in the end zones (which correspond to the portions of the field having a substantially semicircular shape in plan view beyond dashed lines 20) preferably has a greater height H2 than height H1 of the curved area 6 along the sidelines. The radius of curvature R is the same. The quarter pipe may be a full quarter pipe, thus having an angle A2 of 90 degrees, along with a portion that extends directly upward for a distance E, such that R+E=H2. The flat portion 4*b* of the end zone and a small segment of the curved portion 6 corresponding to a portion thereof defined by a line 21, the bottom edge 23 of the curved portion, and the end zone defining line 20 preferably corresponding to a first low-scoring region where a player may score by skating with the ball into the end zone or catching the ball in that region. A higher scoring region or regions may be defined on the curved second area 6. For example, a medium scoring region is defined between the line 21 and a line 22 as shown in FIG. 2, corresponding to a portion 62 of the curved region of FIG. 4, and a highest scoring region 61 is defined by the upper edge of the curved second area 6 and line 22 as shown in FIG. 4. These medium and highest scoring regions are also defined by a point X which may be 45 degrees along the curved second area. A player catching the ball while in the region 62 or 61 will score an appropriate amount of points relating to that region. Alternatively, curved area 61 and flat area 4*b* may be a first (low) scoring region and upper curved region 62 may be a second (high) scoring region.

As is evident from the above, in a preferred version of the invention, the curved second area in the end zone extends higher and thus the lip is higher in the end zone than at the sidelines. In order to maintain a constant curvature, preferably the field bulges in plan view of FIG. 2 at or proximate end zone lines 20 to accommodate the increased lateral distance necessary to go from a 60 or 78.5 degree "quarter pipe" to a 90 degree quarter pipe. To make H1 twelve (12) feet high, with a radius of curvature of fifteen (15) feet, the angle A1 would be approximately 78.5 degrees.

The field does not have any goal posts. The entire field and lip is in play. Preferred materials for the field include a skating surface of a type suitable for in-line skating. Such a surface may include a reinforced polypropylene snap-together low friction surface sold under the trademark IceCourt™, manufactured by IceCourt located in Charleston, S.C. The materials for the quarter pipe and lip may include a relatively hard but skatable plastic or concrete, or other sufficiently durable and skatable material. If concrete, or even if plastic, it could be covered by the same material as used for the flat area to make it skatable and softer for safety.

Preferred dimensions for the field include the following:

The length L1 between the goal lines 20 is ninety (90) yards;

Between the end zones are five long yard line markers, each one about one yard wide, and each being located from its beginning to the beginning of the next line fifteen (15) yards apart, dividing the field into six 15-yard sections;

The width W1 of the flat section 4 would be about forty-five (45) yards and the width W2 of the field not including the lip would preferably be fifty-five (55) yards. The longest length L2 of the field not including the lip would be one hundred twenty (120) yards, such that each end zone is fifteen (15) yards deep;

The lip width W is preferably one and a half to two feet wide (1½ to 2);

The radius of curvature R is preferably fifteen (15) feet, and the preferred section of quarter pipe for the sidelines is seventy-eight and one half (78.5) degrees such that the height H1 is twelve (12) feet and the width W3 is fourteen and seven-tenths (14.7) feet;

The width W4 in the end zone of the quarter pipe is fifteen (15) feet and the height is preferably seventeen (17) feet, with the last two (2) feet extending straight upward; and The line defining the different scoring zones on the curved second area in the end zone preferably being at approximately forty-five (45) degrees of the curve in the center of the end zone and extending up to the ninety (90) degree mark at the sides of the end zone.

Due to the fast nature of the game, it may be necessary to electronically monitor out of bounds or the end zone lines by means of electronic beams B from beam transmitters T and sensors 5 shown in FIG. 2. In addition, the use of instant replay on occasion may prove invaluable. Monitoring out of bounds may also be done by providing a pressure-sensitive switch along the out of bounds area 31 adjacent the lip.

For safety, the lip may be padded using, e.g., a foam material which is durable, e.g., a skinned high-density urethane foam. (The wheels of the players' in-line skates may be made of the same or substantially the same material.) In addition, the lip may have a curved portion 8*b* all the way around the field. The curved portion 8*b* preferably would be part of the foam, yet smoothly join the quarter pipe 6. A radius of curvature of the curved portion 8*b* would be about six (6) inches.

Outside the padded lip, there may be a dropped out of bounds area 31, e.g., a one-inch drop. This may help demarcate the out of bounds and may also help to activate the pressure-sensitive switch.

It should also be noted that the field has a dog-bone shape in the preferred embodiment, and that the end zone is preferably a semi-circle. However, the end zone can be made with a tighter curvature or a smaller portion of a semi-circle such that the dog-bone shape is not necessary. In other words, the end zone will curve inward as fast or faster than the rise between the height of the sidelines and the height of the end zone.

It should also be noted that the curve of the sideline quarter pipe being less then ninety (90) degrees has a safety aspect to it. When players fall or are hit by an opposing player, their momentum should be such that they will not be pushed out toward the center of the field, and thus they will avoid falling the full height of the quarter pipe. This also keeps the height of the quarter pipe lower than the end zone. In the end zone, the quarter pipe is curved about a vertical axis as well, and thus tends to wrap around a player. Therefore, even if a player is hit or falls with momentum toward the center of the field, the player or players will tend to fall onto a curved portion of the quarter pipe thus minimizing the impact.

Although various preferred dimensions for the field (including parts thereof) have been provided herein, it is important to understand that the field preferably is designed to fit within an existing football stadium. However, the field may be larger or smaller. It could be designed to fit within an existing indoor hockey facility, and the number of players would then be modified, as appropriate, e.g., seven (7) players per side.

Players would normally sit on a bench 30 and players would skate in and skate off the field. Injured players may be removed by means of a stretcher or platform on rollers lowered and raised by use of a winch, or by providing a liftable panel section of the curved portion of the playing surface. This section would be pivotably mounted.

Figure 5:
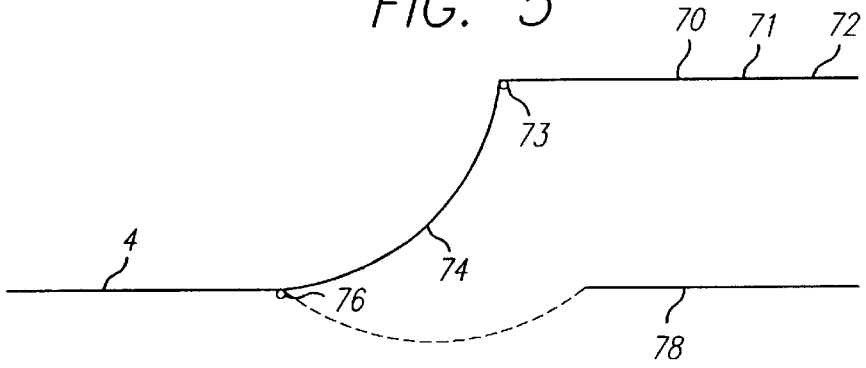
FIGS. 5, 6 and 7 are partial schematic views of a door, showing it in closed, partially folded and fully folded (open) positions, respectively, which door may be provided in the quarter pipe at the sidelines or the end zones to assist in moving personnel on or off the field, or other equipment on or off the field where use of the quarter pipe is impractical.
Figure 6:
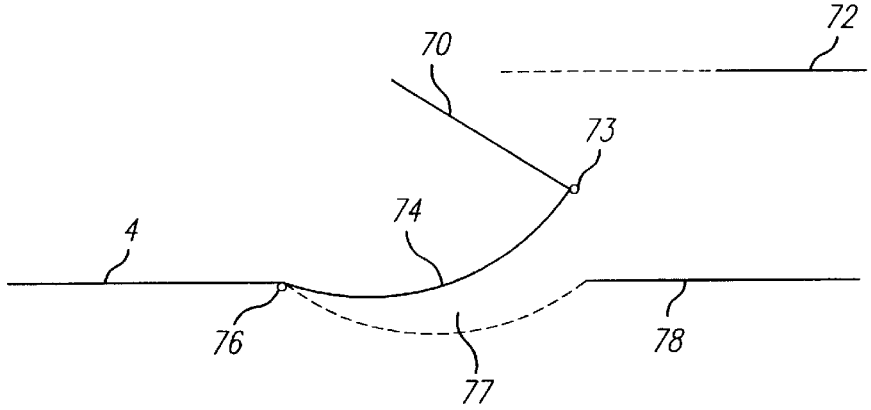
Figure 7:
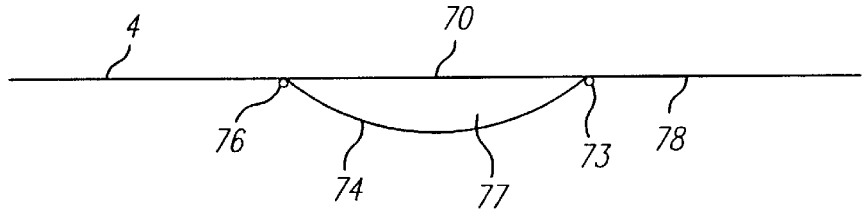
Figure 8:
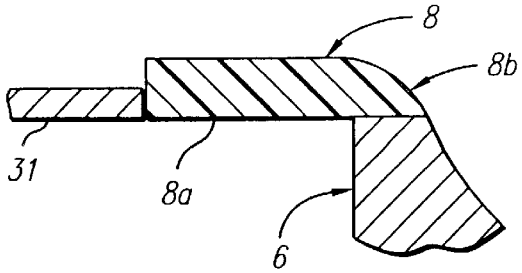
FIG. 8 is a sectional view of the top portion of the quarter pipe, the lip, and a portion of the adjacent out of bounds taken along the sideline of the field.

A suitable pivotably mounted section of the field is shown schematically in FIGS. 5 to 7. A portion 70 of the lip and out of bounds area 31 (of FIGS. 1–2) beyond the lip has a space or gap 71 between it and another portion 72. This portion 70 or plate 70 is connected by a hinge 73 to the curved second surface 6 at a section 74. Section 74 is in turn hinged to or just below the flat surface 4 by a hinge 76. There is a curved recess 77 in the ground below the curved section 74 which matches the curved section 74. A motor or motors, hydraulics, linkage arms and a controller to control folding and unfolding of the curved section 74 and plate 70 are within the skill of one of ordinary skill in the art. In this embodiment, the curved surface 6 would preferably be made out of a strong plastic material to minimize its weight.

In operation, the folding process starts by operating a controller, which then causes a hydraulic-powered linkage arm (or arms) to extend and rotate the plate 70 counter-clockwise and another hydraulic-powered linkage arm (or arms) to retract and rotate the curved section clockwise. FIG. 5 shows the unfolded or closed position and FIG. 6 shows a partially folded or partially open position. The arms fully retract the curved section 74 into the curved recess 77 and the plate 70 is fully folded over the curved section 74 and seats on the lower edge of the curved section 74 or flat surface 4 and the other end of the plate 70 is flush with an access ramp 78 as shown in FIG. 7. The ramp 78 leads to locker rooms, exits, training rooms, emergency facilities, maintenance equipment, etc. To unfold the door, the reverse operation takes place. The hydraulic arms may alone be sufficient to hold the curved section 74 and plate 70 in place when in the closed or unfolded position of FIG. 5. If not, latching mechanisms such as electromagnetic locks operated by the controller to hold the hinges and to hold the plate 70 to the portion 72 may be used.

The rules of the game would include the entire playing surface, including the flat first area, curved second area and lip being in play, and out of bounds being beyond the lip of the field. Accordingly, players can skate not only on the flat area but also on the curved area and on the lip. Preferably, players may remain perched on the lip, but only for a limited time such as three (3) seconds. There are no goal posts and no field goals or conventional point after attempts. Rules may also include the following:

1. Use of a ball similar to U.S. football in size. It may be provided with enhanced gripping areas such as elongated high friction strips to improve gripping, as players should wear protective gloves. The ball may also have sensors on it to enhance monitoring and statistical record keeping.
2. Number of players opposing each other may vary from eleven to fifteen players per side or less for smaller fields.
3. Player is out of bounds when one of his in-line skates touches beyond the lip of the playing field.
4. Player obtains points in a variety of ways.
   a. Moving the ball across the lower scoring zone by carrying it.
   b. Catching the ball in the lower scoring zone.
   c. Catching the ball in the upper scoring zone.
5. Play is stopped when opponent stops momentum of player in possession of ball and referee blows whistle.
6. Play is stopped when opponent tackles player with the ball and his knee touches the playing surface and referee blows whistle or when player in possession of ball goes out of bounds.
7. No on-side kicks allowed during kickoffs. Ball must be kicked a minimum of sixty-five (65) yards to be returned by opposing team. Ball after being kicked 65 yards may be recovered by either team.
8. Ball may be advanced toward opponent's goal by running and passing.
9. The team on offense has four downs to move the ball a minimum of fifteen yards toward the opponent's goal line to accomplish a first down. If not accomplished, possession of the ball transfers over to the opposing team.
10. Players may not stop momentum or perch on upper lip of playing field longer than three (3) seconds.
11. Player may never block opponent below waist area within one yard outside line of scrimmage.

12. Defensive p layers may only body check or hand check progress of opponents within ten yards from the line of scrimmage once the play begins.

13. Offensive player may never tackle or block opponent by grabbing face mask.

14. Game consists of four 15-minute quarters with a 30-minute half time.

15. Scoring in game consists of running with or catching ball in lower scoring zone for a total of four points and catching ball in higher zone for a total of seven points in a two scoring zone embodiment.

16. Each team allowed three time-outs per half. Instant replay will be used throughout the game. Each team will be allowed four challenges to a ruling on a play per half. If instant replay results in a change of the call by the referee, the challenger benefits and is not charged a time-out. Otherwise, one time-out is lost by the challenger.

The rules may otherwise be the same or comparable to regular football or be varied as needed to accommodate field size and other constraints.

What is claimed is:

1. A playing field for a combination football and in-line skating game, the field comprising:

a first flat surface area having a substantially rectangular shape with two straight first long sides and two second short sides;

a concavely curved second surface area bounding the first area and having a lower edge and an upper edge, and lower edge being contiguous with edges of the flat surface area and the upper edge being higher than and remote from the flat surface area;

an upper flat lip surface area extending around the curved second surface area contiguous with the upper edge of the curved second surface area; and means comprising lines defining an end zone proximate each of the second short sides, each end zone having a flat surface area portion and a curved surface area portion of the curved second surface, wherein a width of an outer boundary of the field, proximate where the longer first sides of the first surface area meet the second sides of the first surface area, increases.

2. The playing field of claim 1, wherein a height of the lip around the second curved surface area along the long sides of the rectangle is shorter than a height of the lip around the second curved surface area at the two second sides.

3. The playing field of claim 2, wherein a height of the lip proximate the second sides of the first surface area is greater than a height of the lip proximate the straight longer first sides of the first surface area.

4. The playing field of claim 2, wherein a radius of curvature of the curved second surface area is substantially constant, except proximate the upper edge in the end zone.

5. The playing field of claim 3, wherein a radius of curvature of the curved second surface area is substantially constant, except proximate the upper edge in the end zone.

6. The playing field of claim 1, wherein the longer first sides of the first surface area are about ninety yards long, the end zones are about fifteen yards long, and the width of the playing field is about fifty-five yards.

7. The playing field of claim 6, wherein the lip is about one and one half to two feet wide.

8. The playing field of claim 1 having no goal posts.

9. The playing field of claim 1, wherein the two second short sides of the flat surface area are convexly curved.

10. The playing field of claim 1, further comprising means for folding a portion of the curved second surface area to allow easy access to the flat surface area of the playing field.

11. The playing field of claim 1, wherein an upper edge of the curved second surface and an inner edge of the lip surface are joined by a convexly curved portion.

12. The playing field of claim 1, wherein the lip surface is formed by a padded material.

13. The playing field of claim 1, wherein the lip surface is higher than an out of bounds surface adjacent thereto.

14. The playing field of claim 1, wherein the second curved surface has a partial circular curve.

15. A method of playing a game of football on in-line skates on a playing field, the playing field having a first flat surface area, a concavely curved second surface area bounding and contiguous with the first area, and a lip area, surrounding the first area, the method comprising steps of playing conventional football modified by at least the following steps:

players must wear in-line skates; and the first and second surface area and the lip are in play for players to skate on wherein a ball is out of play when it is passed and it hits the curved second area, lip or flat first surface area before being caught.

16. The method of claim 15, wherein there are two end zones defined at each end of the field by the curved portion of the first area, the curved second area bounding the curved portion of the first area, and the lip bounding the second area, the flat area in the end zone comprising a first scoring region where a player may score a first number of points and the curved second area in the end zone comprising a second scoring region where a player may score a second number of points greater than the first number, wherein points are scored by skating with a ball into the end zone or catching a ball while in the end zone.

17. The method of claim 15, wherein players may skate or stand on the lip for no more than a predetermined period of time.

18. The method of claim 15, wherein there are no field goals.

19. The method of claim 15, wherein there are no field goals.

20. The method of claim 15, wherein the end zones are each about fifteen yards long and the remaining portion of the field is about ninety yards long.

21. The method of claim 15, wherein the second curved surface is a partial circular surface, and players skate on the partial circular curved surface.

22. A playing field for a combination football and in-line skating game, the field comprising:

a flat first surface area having a substantially rectangular shape with two straight first long sides and two second short sides;

a concavely curved second surface area bounding the first area and having a lower edge and an upper edge, and lower edge being contiguous with edges of the flat surface area and the upper edge being higher than and remote from the flat surface area;

an upper flat lip surface area extending around the curved second surface area contiguous with the upper edge of the curved second surface area;

means comprising lines defining an end zone proximate each of the second short sides, each end zone having a flat surface area portion and a curved surface area portion of the curved second surface; and means for folding a portion of the curved second surface area to allow easy access to the flat surface area of the playing field.

23. The playing field of claim 22, wherein an upper edge of the curved second surface and an inner edge of the lip surface are joined by a convexly curved portion.

24. The playing field of claim 22, wherein the lip surface is formed by a padded material.

25. The playing field of claim 22, wherein the lip surface is higher than an out of bounds surface adjacent thereto.

26. The playing field of claim 22, wherein the second curved surface has a partial circular curve.

* * * * *